US009958244B2

(12) United States Patent
Seeman et al.

(10) Patent No.: US 9,958,244 B2
(45) **Date of Patent: *May 1, 2018**

(54) COMPOSITE PROJECTILE AND CARTRIDGE WITH COMPOSITE PROJECTILE

(71) Applicant: EINSTEIN NOODLES, LLC, Charleston, SC (US)

(72) Inventors: Daniel Jonathan Seeman, Charlotte, NC (US); Dewey Privette, Charlotte, NC (US)

(73) Assignee: EINSTEIN NOODLES, LLC, Charleston, SC (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/132,952

(22) Filed: Apr. 19, 2016

(65) Prior Publication Data

US 2016/0252336 A1 Sep. 1, 2016

Related U.S. Application Data

(63) Continuation of application No. 14/194,322, filed on Feb. 28, 2014, now Pat. No. 9,322,623, which is a (Continued)

(51) Int. Cl.
*F42B 12/74* (2006.01)
*F42B 5/02* (2006.01)
(Continued)

(52) U.S. Cl.
CPC ..... *F42B 12/745* (2013.01); *F42B 5/02* (2013.01); *F42B 12/74* (2013.01); *F42B 33/00* (2013.01); *F42B 30/02* (2013.01); *F42B 33/001* (2013.01)

(58) Field of Classification Search
CPC ..... F42B 5/02; F42B 12/74; F42B 12/745; F42B 30/02; F42B 33/00; F42B 33/02; F42B 33/001
(Continued)

(56) References Cited

U.S. PATENT DOCUMENTS 2,835,198 A * 5/1958 Brombacher ..... F42B 5/03 102/438
2,995,090 A * 8/1961 Daubenspeck ..... F42B 12/745 102/529
(Continued)

FOREIGN PATENT DOCUMENTS

WO WO 2014193497 A2 * 12/2014 ..... F42B 5/02
WO WO 2014193497 A3 * 5/2015 ..... F42B 5/02

OTHER PUBLICATIONS

Written Opinion of the International Searching Authority for PCT/US14/17516; dated Mar. 17, 2015.*
(Continued)

*Primary Examiner* — James S Bergin
(74) *Attorney, Agent, or Firm* — Roeder & Broder LLP; James P. Broder

(57) ABSTRACT

A projectile includes a toughened polymer resin, a curative agent and a particulate filler. The curative agent cures the toughened polymer resin. The particulate filler is distributed throughout the resin. The particulate filler has a density greater than a density of the resin. In some embodiments, the cured toughened polymer resin can be 20 to 30 percent by weight of the total projectile composition. The projectile has an average density that is less than the density of lead. In certain embodiments, the particulate filler can be 70 to 80 percent by weight of the total projectile composition. The particulate filler can include at least one of copper, tungsten, lead, iron and steel.

10 Claims, 2 Drawing Sheets

Related U.S. Application Data continuation-in-part of application No. 13/772,914, filed on Feb. 21, 2013, now Pat. No. 8,689,696.

(60) Provisional application No. 61/942,589, filed on Feb. 20, 2014.

(51) Int. Cl.
*F42B 33/00* (2006.01)
*F42B 30/02* (2006.01)

(58) Field of Classification Search
USPC ..... 102/430, 439, 444, 501, 502, 506, 517, 102/529
See application file for complete search history.

(56) References Cited

U.S. PATENT DOCUMENTS 3,123,003 A * 3/1964 Lange et al. ..... C22C 32/0094 102/529
5,237,930 A * 8/1993 Belanger ..... F42B 12/745 102/506
5,616,642 A * 4/1997 West ..... F42B 12/745 102/506
5,786,416 A * 7/1998 Gardner ..... C08K 3/08 102/517
6,048,379 A * 4/2000 Bray ..... C08K 3/08 102/517
6,517,774 B1 * 2/2003 Bray ..... C08K 3/08 419/23
7,977,420 B2 7/2011 Nielson et al.
8,347,788 B1 * 1/2013 LeaSure ..... F42B 12/34 102/506
8,365,672 B2 * 2/2013 Calero Martinez ..... F42B 12/74 102/506
8,689,696 B1 * 4/2014 Seeman ..... F42B 5/02 102/439
9,134,102 B2 * 9/2015 Flowers ..... F42B 12/745
9,170,080 B2 * 10/2015 Poore ..... F42B 12/745
9,212,878 B2 * 12/2015 Seeman ..... F42B 12/74
9,322,623 B2 * 4/2016 Seeman ..... F42B 12/74
9,366,516 B2 * 6/2016 Hook ..... F42B 33/001
9,528,805 B2 * 12/2016 Seeman ..... F42B 12/745
9,683,818 B2 * 6/2017 Lemke ..... F42B 5/285
2003/0101891 A1 * 6/2003 Amick ..... F42B 12/34 102/514

OTHER PUBLICATIONS

International Search Report for PCT/US14/17516; dated Mar. 17, 2015.*

Dow Expoxy Announces new FORTEGA(TM) Toughening Technologies, Press Release by The Dow Chemical Company, Mar. 29, 2011, downloaded Feb. 3, 2014 from http:/Iepoxy.dow.comInewsI2011/20110505b.htm, 2 pages.*

Product Information Sheet by The Dow Chemical Company, Form No. 296-01909-0910-RX, downloaded Feb. 3, 2014 from http:I/msdssearch.dow.com/PublishedLiteratureDOWCOM/dh_087610901 b80380876565.pdf?filepath=epoxy/ pdfs/noreg/296-01909.pdf&fromPage=GetDoc, 4 pages.*

DuPont, Surlyn Ionomer Product Information, Copyright 2017, DuPont.

* cited by examiner

COMPOSITE PROJECTILE AND CARTRIDGE WITH COMPOSITE PROJECTILE

CROSS-REFERENCE TO RELATED APPLICATION

For purposes of the United States, the present application is a continuation-in-part patent application of, and claims domestic priority under 35 U.S.C. § 120 to, U.S. nonprovisional patent application Ser. No. 13/772,914, filed with the U.S. Patent & Trademark Office on Feb. 21, 2013, which '914 application, any publication thereof, and any patent issuing therefrom, are incorporated by reference herein. The present application also is a nonprovisional patent application of, and claims priority under 35 U.S.C. § 119(e) to, U.S. provisional patent application 61/942,589.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records, but all other copyright rights whatsoever are reserved.

BACKGROUND OF THE INVENTION

This invention relates generally to projectiles and small arms ammunition, and more particularly to ammunition incorporating composite projectiles.

Conventional small arms ammunition comprises a cartridge having a casing loaded with a propellant powder and a projectile (e.g., a bullet). An impact-sensitive primer ignites the propellant when struck by a gun's firing pin. Projectiles for such ammunition are most typically made from lead or lead alloys. This material has a high density providing good velocity retention, range, muzzle energy, and target penetration, while being soft enough to engage the rifling in a barrel without damaging the barrel.

Unfortunately, lead is a source of both indoor and outdoor pollution, and is also rising in cost. Attempts have been made in the prior art to replace lead in projectiles. However, these materials have either been expensive (e.g., tungsten) or have significant performance limitations in terms of structural integrity and target penetration (e.g., polymers). Furthermore, even when projectiles are made from lead, their expansion characteristics (and related temporary and permanent wounding effects) are limited when incorporated into pistol ammunition, because of the relatively low muzzle energy levels that can be safely generated in a pistol. This limits the so-called "stopping power" of conventional pistol ammunition.

Other attempts have been made to replace lead in projectiles, as evidenced, for example, by U.S. Pat. No. 5,237,930; U.S. Pat. No. 5,399,187; U.S. Pat. No. 5,616,642; U.S. Pat. No. 5,786,416; U.S. Pat. No. 6,048,379; U.S. Pat. No. 6,630,231; and U.S. Pat. No. 6,823,798.

Nonetheless, it is believed that there remains a need for a projectile with performance characteristics at least as good as a lead projectile; for a projectile that is more cost effective and more environmentally friendly than lead projectiles; and/or for a projectile providing enhanced stopping power or wounding effect compared to lead projectiles.

BRIEF SUMMARY OF THE INVENTION

It is believed that one or more such perceived needs are addressed by one or more preferred aspects of the present invention, in which a projectile comprises a toughened polymer matrix—and specifically a toughened polymer resin comprising an elastomer-modified epoxy functional adduct formed by the reaction of a bisphenol A liquid epoxy resin and a carboxyl terminated butadiene-acrylonitrile elastomer; a particulate filler distributed in and through the toughened polymer resin; and a curative agent by which the toughened polymer resin with distributed particulate filler is cured. The cured toughened polymer resin with distributed particulate filler forms a projectile body in a desired projectile shape, e.g., the shape of a bullet. Preferably the elastomer content is 40% by weight with respect to the toughened polymer resin; preferably the filler has a density greater than a density of the resin; and preferably the projectile has an average density less than the density of lead.

According to other aspects of the invention, ammunition cartridges include such projectiles.

The present invention is directed toward a projectile including a toughened polymer resin, a curative agent and a particulate filler. The curative agent cures the toughened polymer resin. The particulate filler is distributed throughout the resin. The particulate filler has a density greater than a density of the resin. Further, in some embodiments, the cured toughened polymer resin is 20 to 30 percent by weight of the total projectile composition.

In certain embodiments, the projectile has an average density that is less than the density of lead.

In various embodiments, the projectile has an average density that is less than 45 percent of the density of lead.

In some embodiments, the particulate filler is 70 to 80 percent by weight of the total projectile composition.

In certain embodiments, the particulate filler includes copper.

In various embodiments, the projectile is substantially lead-free.

In some embodiments, the particulate filler includes a material selected from the group consisting of copper, tungsten, lead, iron and steel.

The present invention is also directed toward a cartridge that includes a casing and various projectiles described herein, with the projectile projecting from an end of the casing.

In certain embodiments, the cartridge can also include a propellant that is adapted to propel the projectile from the casing.

In various embodiments, the casing can be formed from a material selected from the group consisting of brass, aluminum alloy and plastic.

The present invention is also directed toward a projectile that includes a toughened polymer resin, a curative agent and a particulate filler distributed throughout the resin. In some embodiments, the filler has a density greater than a density of the resin. Further, the particulate filler can be 70 to 80 percent by weight of the total projectile composition.

The present invention is also directed toward a method of manufacturing any of the projectiles and/or cartridges described herein.

BRIEF DESCRIPTION OF THE DRAWINGS

The invention may be best understood by reference to the following description taken in conjunction with the accompanying drawings, wherein FIG. 1 illustrates a partially-sectioned side view of a cartridge—including a projectile—constructed in accordance with an aspect of the present invention; and wherein

DETAILED DESCRIPTION OF THE INVENTION

Figure 1:
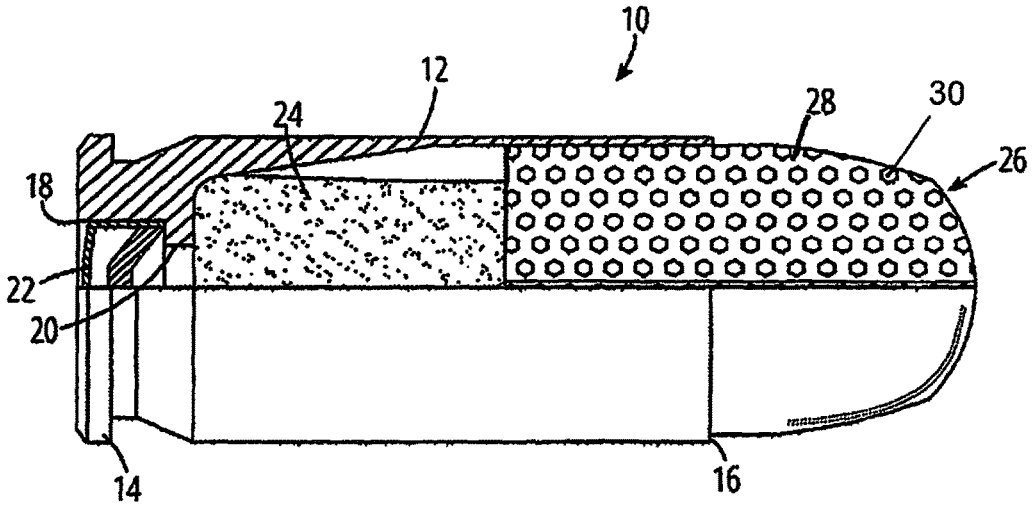

Referring to the drawings, FIG. 1 illustrates an exemplary cartridge 10 constructed in accordance with one or more preferred aspects of the present invention.

As shown in FIG. 1, the cartridge 10 includes a generally cylindrical casing 12 with a base 14 at one end, and a mouth 16 at the opposite end at which a projectile 26 extends from the casing 12. For the purposes of illustration the example cartridge is a 11.4 mm (.45 in.) caliber Automatic Colt Pistol cartridge (commonly identified as ".45 ACP"). However, it will be understood that the principles of the present invention may be extended to any type or caliber of cartridge.

The base 14 includes a primer pocket 18 with a flash hole 20 communicating with the interior of the casing 12. A conventional primer 22 is disposed in the primer pocket 18. A powder charge 24 of propellant (such as conventional smokeless gunpowder) is disposed in the interior of the casing 12, in communication with the flash hole 20.

The casing 12 is of conventional construction, for example it may be drawn from brass or aluminum alloys or molded from plastic. Any commercially available casing is suitable for this purpose. It is also known to create "caseless" ammunition rounds wherein a propellant charge is loaded into a projectile having an extended base forming a powder enclosure, or wherein propellant is mixed with a suitable binder and molded into the shape of a cartridge case. In this type of ammunition the projectile is fixed in position relative to the propellant. In addition to breech-loading firearms, the principles of the present invention are applicable to such caseless ammunition, as well as to muzzle-loading firearms using either separate powder-and-ball or combustible (e.g., paper) cases.

The projectile 26 is retained in the mouth 16 of the casing. The projectile 26 comprises a non-metallic matrix 28 with a particulate filler 30 distributed therethrough. The projectile 26 preferably is lead-free. As used herein, the term "lead-free" refers to a projectile which does not have lead intentionally included in its composition and which includes lead only to the degree that it is an unavoidable impurity in other components of the composition. Nonetheless, the filler may comprise lead in alternative embodiments.

More specifically, the matrix 28 is a toughened polymer resin. As used herein, the term "toughness" generally refers to the ability to absorb energy and plastically deform before fracturing, or in other words the opposite of "brittle." The toughness or brittleness of a particular material is a matter of degree. In industry usage, a "toughened resin" typically refers to a polymer containing an elastomeric component which imparts toughness. As used herein, "toughened" describes the cured state of the resin, and it is noted that the chemical component providing the quality of toughness may be provided by any of the constituent components used to produce the final resin, or may come about as a result of the curing reaction. A preferred toughened epoxy resin is an elastomer-modified epoxy functional adduct formed by the reaction of a bisphenol A liquid epoxy resin and a carboxyl terminated butadiene-acrylonitrile elastomer. The elastomer content is 40% by weight. This material is commercially available from The Dow Chemical Company under the trademark FORTEGRA™ 201.

The filler 30 may be any powder or particulate. Non-limiting examples include lead, depleted uranium, copper, tungsten, bismuth, ceramic, bronze, iron and steel, clay, mica, silica, calcium carbide, and micro-encapsulated materials (wherein a selected material is encapsulated in a particulate-sized shell). In any case, the filler 30 preferably is of higher density than the cured matrix 28.

It is believed that the aforementioned preferred combination of materials forming a projectile has important advantages over conventional metal alloy projectiles. In particular, it is believed that projectiles made from this combination of materials can have significantly improved stopping power and wounding performance than conventional homogenous metallic projectiles, even though they may have less mass than conventional projectiles. Depending on material selection, the projectiles also may be less toxic than conventional lead projectiles.

Example 1

Projectiles have nominal dimensions conforming to the .45 ACP standard were produced using varying amounts of the toughened epoxy resin described above as the matrix—and specifically a toughened polymer resin comprising an elastomer-modified epoxy functional adduct formed by the reaction of a bisphenol A liquid epoxy resin and a carboxyl terminated butadiene-acrylonitrile elastomer, and iron powder (US Standard Mesh size 108) as the filler, using the following process. First, the epoxy resin was heated to an appropriate temperature of about 49° C. (120° F.) to reduce its viscosity and permit mixing and distribution of the filler. The proper temperature is dependent on particle size. The finer the powder, the lower the viscosity needs to be for proper mixing. Next, the filler was mixed into the resin. After mixing, a conventional hardener (an amine) was added to the resin/filler mixture, at a ratio of 10 parts resin to 1 part hardener. As used herein, the term "hardener" refers to any type of curative agent for the resin. The mixture was then poured into a prepared projectile mold. The resin/filler/hardener mixture was cured to produce an epoxy polymer, and the projectile was removed from the mold.

The finished projectiles were found to have the filler distributed throughout the resin. The mass of the projectiles varied depending on the type and amount of filler used, as well as the total length of the projectile. It is noted that the mass of the projectile can be varied from a baseline by changing either its density or its volume. This is limited by a need to maintain a certain minimum length to ensure that the projectile does not jam in a barrel and will not tumble during flight. Projectiles were produced with a range of masses from less than 2.6 g (40 grains) to over 5.8 g (90 grains). By comparison, a conventional lead projectile with the same exterior dimensions would typically have a mass of about 14.9 g (230 grains). Accordingly, the average density of the projectiles was less than 45% of the density of a lead projectile of equal exterior dimensions.

For the example caliber tested, and for the specific combination of resin, hardener, and filler used with the example caliber, a range of 20% to 30% by weight of resin was preferred. The preferred proportion of resin will vary with various factors such as the type of resin and hardener, the type and size of filler, and so forth. In one particular tested example, the composition of the projectile was 26% by weight resin and 74% by weight filler. It is believed that the composition and manufacturing method described above results in the epoxy bonding to the iron particle filler creating a homogeneous and cohesive matrix which allows it to withstand the forces created during firing of the projectile. It is believed that the properties of this projectile are such that, in response to an impact of enough force to fracture the projectile, the projectile will break up into large fragments having significant mass that are substantially larger than powder particles, instead of breaking up into powder or dust, which is generally common with known prior art projectiles of composite construction. As an example, the fragments may have a minimum size on the order of about 2.5 mm (0.10 in.), or about 20 times the size of powder particles.

Example 2

The projectiles described above can be incorporated into cartridges having powder loads much greater than conventionally used. In combination with a lower-mass projectile, this generates needed muzzle velocity and energy to have lethality (i.e., temporary and permanent wounding characteristics) similar to a conventional lead projectile, when used as offensive or defensive ammunition.

For example, projectiles described above in .45 ACP caliber, having a weight of about 5.8 g (90 grains), were loaded into cartridges with a powder load sufficient to generate a muzzle velocity of about 701 m/s (2300 ft/s) to 732 m/s (2400 ft/s) when fired from a 12.7 cm (5 in.) long barrel.

The cartridges were found to exhibit unexpected performance characteristics. The projectiles had excellent structural integrity and did not fail or break up in flight even at the extremely high muzzle velocities. This is believed to be a result of a synergistic interaction between the polymer resin and the particulate filler.

The projectiles were fired into water-soaked paper telephone books at a range of about 13.7 m (15 yd). The projectiles exhibited excellent target penetration, approximately 15.2 cm (6 in.) depth. The projectiles also showed a "shotgun blast" effect. In particular, a projectile of nominal .45 ACP diameter, approximately 11.46 mm (0.451 in.) was found to produce an entry hole in a target of about 5.1 cm (2 in.) diameter, and an exit hole much greater than 5.1 cm (2 in.) diameter. In thin, tough targets such as steel drum heads, the same projectile was found to produce a through-hole of about 5.1 cm (2 in.) diameter. It is believed that this is a larger hole than would be expected even with a conventional hollow-point or soft lead "dum-dum" projectiles. Observation after firing suggests that the projectile remained intact in flight to the target. It is believed that the projectiles may expand to a large diameter upon initial contact, creating the large-diameter holes mentioned above. Recovered projectiles were found to be in fragments of a size believed to be significantly larger than powder. The projectiles may have broken up into fragments upon initial contact with the target, or may have broken up after substantial intact expansion. The "shotgun blast" effect and large hole size was observed regardless of exactly when or how the projectile expanded and/or fragmented.

It is noted that the principles of the present invention are believed to be applicable to composite projectiles having other compositions that also display the penetration and expansion/fragmentation properties described above. For example other polymer resins, not necessarily classified as "toughened", may be found that interact with a filler to produce the projectile properties described herein.

This type of expansion and/or fragmentation stands in stark contrast to prior art composite projectiles, which are typically configured to disintegrate into powder-sized particles. This performance was observed when the muzzle energy was about 1.22 kJ (900 ft-lb) or greater. The mass of the projectile and the power charge may be varied to achieve this energy level. The amount of the propellant and the mass of the projectile preferably are selected to produce a muzzle energy of at least 400 foot-pounds when fired from a 5 inch long barrel, and more preferably are selected to produce a muzzle energy of at least 900 foot-pounds when fired from a 5 inch long barrel. Moreover, the perceived recoil of these cartridges was no greater than reference cartridges of the same caliber loaded with conventional jacketed lead projectiles to standard velocities.

Furthermore, the cartridges did not exhibit signs of overpressure, such as case cracking or raised primers, and are therefore believed to be suitable for use in conventional firearms.

These projectiles and ammunition rounds are believed to be especially lethal and suitable for hunting, military, or self-defense purposes while maintaining recoil at levels equal to or less than conventional lead projectile rounds. The performance of these rounds allows a handgun to provide the lethality that is typically associated with rifle ammunition.

The loads may be varied to suit a particular end use. For example, if the projectile mass is reduced to about 2.6 g (40 grains), no penetration of a target is observed. At about 3.9 g (60 grains), some penetration is observed. At 5.2 g to 5.8 g (80 grams to 90 grains), excellent penetration is observed as described above. Projectiles of lower masses may be desirable as target rounds or non-lethal rounds. Projectiles without filler also may be used as target rounds or non-lethal rounds.

Figure 1A:
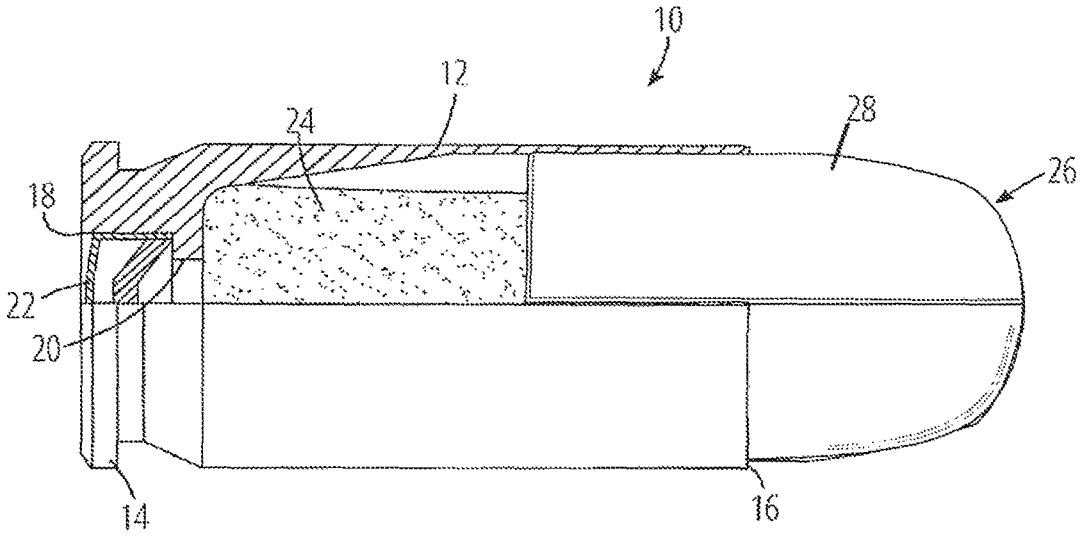
FIG. 1*a* illustrates a partially-sectioned side view of a cartridge—including a projectile—constructed in accordance with another aspect of the present invention.

FIG. 1*a* illustrates a partially-sectioned side view of a cartridge—including a projectile—constructed in accordance with another aspect of the present invention, wherein the same structural components as the cartridge in FIG. 1 are referred to with the same numerals. This second illustrated embodiment in FIG. 1*a* is essentially the same as that of FIG. 1 with the exception that no particulate filler has been included in the projectile.

The foregoing has described composite projectiles and ammunition made from composite projectiles. While specific embodiments of the present invention have been described, it will be apparent to those skilled in the art that various modifications thereto can be made without departing from the spirit and scope of the invention.

What is claimed is:

1. A projectile comprising:

a toughened polymer resin;

a curative agent by which the toughened polymer resin is cured; and a particulate filler distributed through the toughened polymer resin, the particulate filler having a density greater than a density of the toughened polymer resin;

wherein the cured toughened polymer resin is 20 to 30 percent by weight of the total projectile composition.

2. The projectile of claim 1, wherein the projectile has an average density that is less than the density of lead.

3. The projectile of claim 1, wherein the projectile has an average density that is less than 45 percent of the density of lead.

4. The projectile of claim 1, wherein the particulate filler is 70 to 80 percent by weight of the total projectile composition.

5. The projectile of claim 1, wherein the particulate filler includes copper.

6. The projectile of claim 1, wherein the projectile is substantially lead-free.

7. The projectile of claim 1, wherein the particulate filler includes a material selected from the group consisting of copper, tungsten, lead, iron and steel.

8. A cartridge including a casing and the projectile of claim 1, with the projectile projecting from an end of the casing.

9. The cartridge of claim 8, further comprising a propellant that is adapted to propel the projectile from the casing.

10. The cartridge of claim 8, wherein the casing is formed from a material selected from the group consisting of brass, aluminum alloy and plastic.

* * * * *